United States Patent [19]

Wise

[11] 3,942,714

[45] Mar. 9, 1976

[54] TWO-WAY MAILER

[75] Inventor: Lester V. Wise, Old Westbury, N.Y.

[73] Assignee: Federal Business Products, Inc., New York, N.Y.

[22] Filed: Nov. 15, 1974

[21] Appl. No.: 524,322

[52] U.S. Cl. ..... 229/73; 229/85

[51] Int. Cl.[2] ..... B65D 27/06

[58] Field of Search ..... 229/73, 85; 282/25, 11.5 R, 282/11.5 A

[56] References Cited

UNITED STATES PATENTS

| | | | |
|---|---|---|---|
| 2,201,538 | 5/1940 | Holden | 229/73 |
| 3,062,431 | 11/1962 | Rabenold | 229/73 |
| 3,312,385 | 4/1967 | Amort | 229/73 |
| 3,428,237 | 2/1969 | Dowen | 229/73 X |

*Primary Examiner*—William Price
*Assistant Examiner*—Stephen P. Garbe

[57] ABSTRACT

A two-way mailer in the form of a three-sheet pack which is mailable by a company to a customer for billing purposes, the pack containing a bill for goods sold or services rendered. The pack is edge-perforated to define a first removable stub constituted by the left edges of the top and back sheets which are longer than the middle sheet, and a second stub constituted by the left edge of the middle sheet and an inward portion of the back sheet. The face of the top sheet is addressed to the customer, while the face of the middle sheet is addressed to the company. The rear of the top sheet has the bill imprinted thereon, whereas the rear of the middle sheet and the face of the back sheet contain data relating to the payment of the bill. When the customer receives the pack mailed to him, he removes the first stub, making it possible for him to peel off the top sheet and examine the bill on the rear thereof. The customer retains the top sheet as a record of the bill which he pays by inserting a check into the return envelope defined by the middle and back sheets. The back sheet has an edge flap for sealing the return envelope which is then mailed to the company. When the return envelope is received, the second stub is removed to open the envelope, and after the check is withdrawn, the middle sheet is separated from the back sheet to provide record data regarding the received payment for a branch office and the central office of the company.

7 Claims, 11 Drawing Figures

| ACCOUNT NUMBER | BILLED FROM | BILL TO |
|---|---|---|
| 01-033832-01-4 | 06-30-74 | 07-31-74 |
| PREVIOUS BALANCE | PAYMENTS | CURRENT CHARGES |
| 12.00 | 6.00 | 6.00 |
| INSTALLMENT CHARGES | SALES TAX | ABC Co. Inc. |
| .00 | .00 | |
| AMOUNT DUE | DATE DUE | PAYMENT RCD |
| 12.00 | UPON RCPT | 07-11-74 |

Fig. 6.
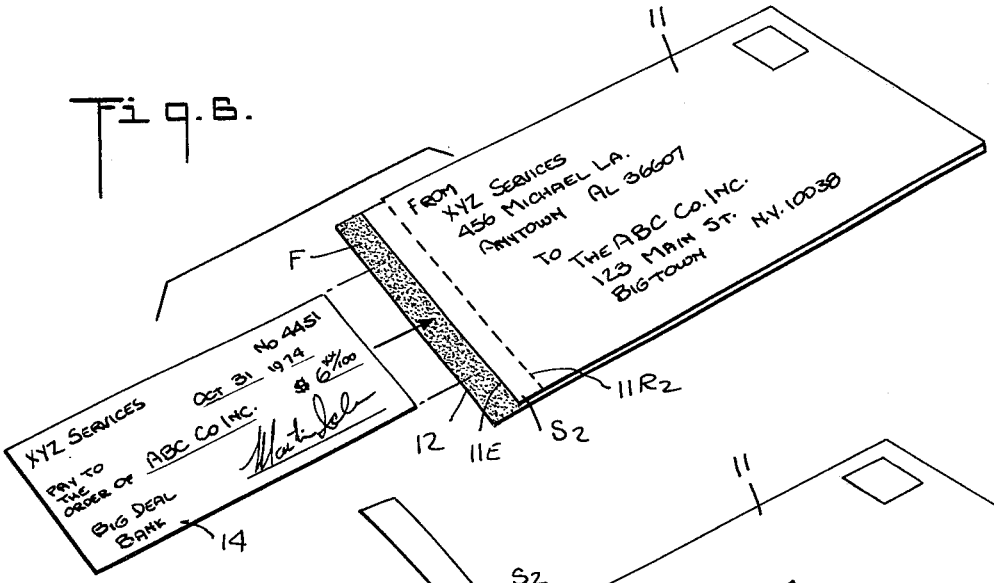
Fig. 8.
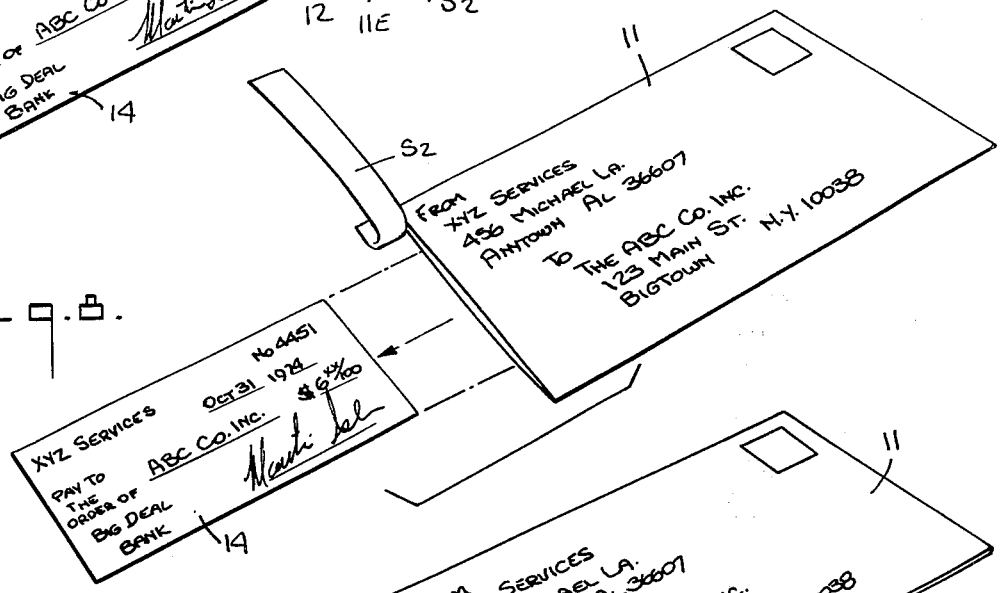
Fig. 10.
| ACCOUNT NUMBER | AMOUNT DUE | AMOUNT PAID |
|---|---|---|
| 01-033832-01-4 | 12.00 | |
| | DATE DUE UPON RCPT | |
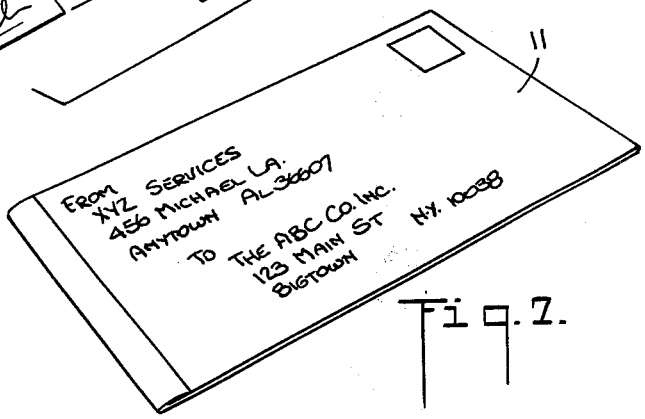
Fig. 7.
Fig. 11.
DATE DUE
UPON RCPT
| TRANS TYPE | ACCOUNT NUMBER | AMOUNT DUE |
|---|---|---|
| 50 | 01-033832-01-4 | 12.00 |
CUSTOMER NAME AND ADDRESS
XYZ SERVICES
456 MICHAEL LA.
ANYTOWN AL 36607
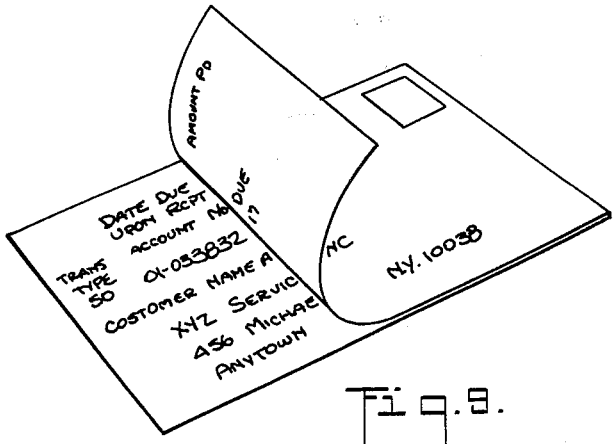
Fig. 9.

TWO-WAY MAILER

BACKGROUND OF INVENTION

This invention relates generally to two-way mailers adapted to forward a bill to a customer and for the customer to return payment to the company sending the bill, and more particularly to a two-way mailer in the form of a pack having three superposed sheets which not only define the forwarding and return envelopes but also the bill and two distinct records of the billing transaction.

In order for a large company such as a telephone company, an electric power utility or a large department store having many branches, or for that matter any other commercial facility which sells goods or renders services to a multiplicity of customers, to bill each customer on a monthly or other periodic basis, it is the usual billing practice to enclose each bill in a forwarding envelope addressed to the customer. Also inserted in this envelope is a return envelope for payment as well as advertising folders and other types of material relating to the company's business. The customer receiving this pack is expected to send back his payment check and the record section of the bill in the return envelope.

While the preparation of bills for customers and the addressing of the forwarding envelopes are generally carried out by high-speed computer techniques, it has heretofore been necessary to employ special machines for stuffing the forwarding envelope. This is not only a time consuming and costly operation, but because of machine or human error it gives rise to troublesome mistakes. One may, however, minimize the possibility of inserting a bill for one customer in an envelope addressed to another customer by printing his address on the bill itself and inserting the bill with the address exposed in a window-type envelope. But such envelopes are more costly than ordinary envelopes and machine insertion is still required.

In order to avoid the need for separate forwarding and return envelopes, it is known to provide convertible envelopes which carry out both functions, such as those disclosed in the following U.S. Pat. Nos.: 2,759,658, 2,887,944, 3,184,150, and 3,111,336. But the making of envelopes of this type usually involves folding operations and cannot be carried out on a low-cost, continuous form basis. Moreover, it is still necessary with such envelopes to separately prepare and insert the bill. Also, the company receiving payment in the return envelope must then proceed to prepare records of the billing transaction.

Another characteristic of modern billing procedures which cannot be overlooked in this era of ecological sensitivity and conservation, is waste. With billing procedures currently practiced, the forwarding and return envelopes are discarded after use, since they no longer serve a useful purpose. Inasmuch as hundreds of millions of such envelopes are used every year by American corporations, the resultant waste has assumed astronomical proportions.

SUMMARY OF INVENTION

In view of the foregoing, it is the main object of this invention to provide a two-way mailer formed by a pack of three unfolded, superposed sheets which together define a forwarding envelope and a return envelope, which pack may be mass produced at high speed on a continuous form basis in conjunction with computer techniques for addressing both envelopes.

More significantly, it is an object of this invention to provide a pack of the above type in which the bill for the customer need not be a separate insert but may be printed on the rear face of the top sheet whereby upon receipt of the pack by the customer and the removing of a stub, the top sheet may be peeled from the pack and the bill examined.

Also an object of this invention is to provide a pack which requires no separate bill insertion and which lends itself to addressing and the imprinting of billing and record data by a computer-controlled, direct image printing by a jet ink transfer system.

Still another object of the invention is to provide a two-way mailer which minimizes the amount of paper required for producing both a forwarding and return envelope as well as a bill and two records of the billing transaction, in that the elements of the pack which constitute the envelopes, when separated from each other, then constitute the bill and the records, thereby avoiding waste.

Briefly stated, these objects are attained in a pack formed by three superposed sheets having the same dimensions save for the middle sheet whose left edge falls short of the matching left edges of the top and back sheets. The sheets are marginally secured together except at the left edge of the middle sheet which is left free, the middle sheet defining a forwarding envelope pocket with the top sheet and a return envelope pocket with the back sheet.

The top and back sheets are perforated along corresponding first lines which lie intermediate the interconnected left edges of these sheets and the free left edge of the middle sheet to define a first stub. The zone of the back sheet between the first perforation line and the left edge of the middle sheet constitutes a return envelope flap having an adhesive layer thereon. The middle and back sheets are perforated along corresponding second lines which lie adjacent the left edge of the middle sheet to define a second stub.

When, upon receipt of the pack by the customer, the first stub is removed, the top sheet whose face is addressed to the customer may be peeled from the pack to expose the address appearing on the face of the middle sheet to thereby extinguish the forwarding envelope. The bill to the customer is printed on the rear of the top sheet, the check in payment thereof being then inserted in the return envelope pocket and the flap folded over and sealed onto the second stub. Upon receipt of the return envelope by the company, the second stub is removed and the check withdrawn, after which the middle sheet is separated from the back sheet. A record of the billing transaction appears both on the rear of the middle sheet and on the face of the back sheet so that one record may be kept at a branch office and another at the central office of the company.

For a better understanding of the invention as well as other objects and further features thereof, reference is made to the following detailed description to be read in conjunction with the accompanying drawings, wherein:

FIG. 6 shows, in perspective, the return envelope section of the pack with a payment check about to be inserted therein;

FIG. 7 shows the sealed return envelope ready for mailing to the company;

FIG. 8 shows the received return envelope with the minor stub removed and the payment check withdrawn;

FIG. 9 shows the middle sheet being separated from the back sheet;

FIG. 10 shows the rear of the middle sheet; and

FIG. 11 shows the face of the back sheet.

DESCRIPTION OF INVENTION

Referring now to FIGS. 1 to 5, there is shown a two-way mailer in accordance with the invention, the mailer being in the form of a pack constituted by top, middle and back sheets 10, 11 and 12 which have the same dimensions except for the middle sheet whose left edge 11E falls short of the matching left edges of the top and back sheets 10 and 12. The sheets are marginally secured together except at the edge 11E of the middle sheet which remains free. For this purpose, the sheets are preferably held together by spots of adhesive so that they may later be peeled apart without difficulty.

Figure 1:
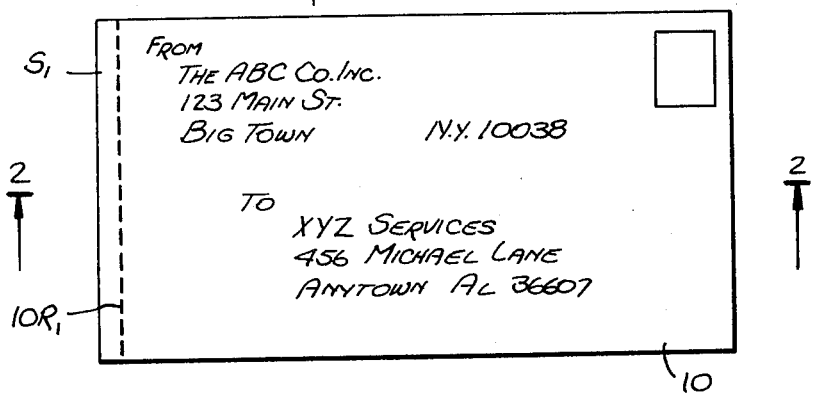
FIG. 1 is a plan view of a two-way mailer pack in accordance with the invention.
Figure 2:
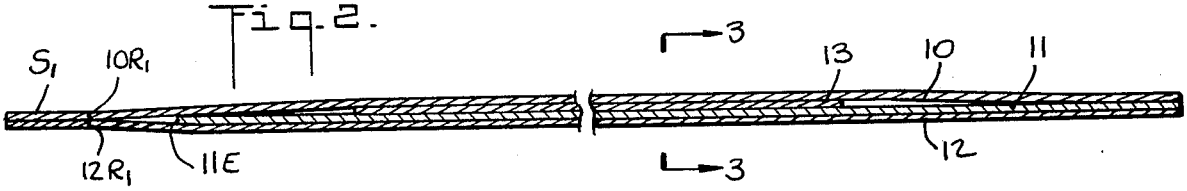
FIG. 2 is a longitudinal section taken in the plane indicated by line 2—2 in FIG. 1.
Figure 3:
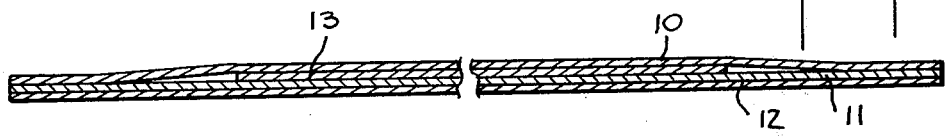
FIG. 3 is a longitudinal section taken in the transverse plane indicated by line 3—3 in FIG. 2.

A pack in accordance with the invention may be used for any type of modern billing transaction. For purposes of illustration only, we shall identify the company which provides goods or services to be billed as the ABC Co., Inc. of Big Town and one of its customers to be billed as XYZ Services of Anytown. As shown in FIG. 1, the face of the top sheet 10 is addressed to this customer while the face of the middle sheet 11 is addressed to the company. The respective names of the addressors also appear on these sheets.

Printed on the rear of top sheet 10 is the customer's bill. The bill is in the usual form and contains the customer's account number, the period billed, the previous balance, the amount due and all other data appropriate to billing. The pocket defined between top sheet 10 and middle sheet 11 constitutes the forwarding envelope of the pack. Since the bill is incorporated in the top sheet, this pocket may be left empty or stuffed with advertising, promotional or any other material, such as insert card 13.

Alternatively, instead of printing the bill on the top sheet, it may be printed on a card to be inserted in the forwarding envelope pocket. The obvious advantage of printing the bill on the rear of the top sheet is that this printing action as well as other required printing steps may be carried out under the control of high-speed computers which store and update the necessary information, thereby avoiding the need for hand insertion of the bills.

Figure 4:
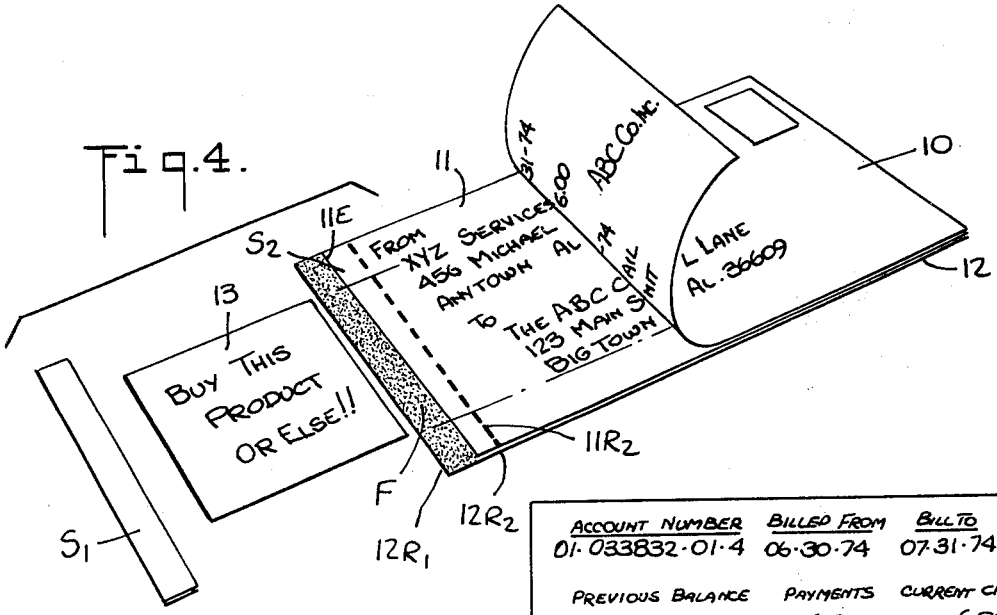
FIG. 4 is a perspective view of the pack shown in FIG. 1, with the major stub removed and an insert from the forwarding envelope withdrawn.
Figure 5:
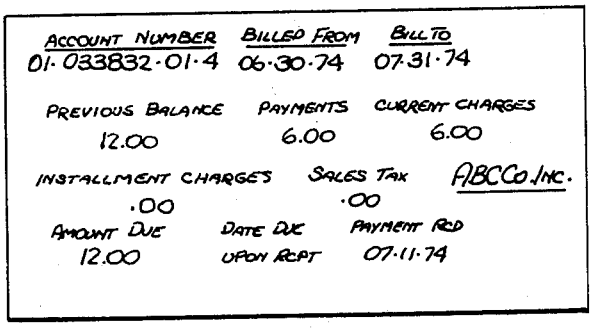
FIG. 5 shows the rear of the top sheet of the pack, which rear has the customer's bill printed thereon.

Top and back sheets 10 and 12 are perforated along corresponding first lines $\mathbf{10R_1}$ and $\mathbf{12R_1}$ which lie intermediate the left edges of these sheets and edge 11E of the middle sheet 11 to define a first or major stub $S_1$. The zone of back sheet 12 between the first line of perforations $\mathbf{12R_1}$ and the edge 11E of middle sheet 11, as shown in FIG. 4, constitutes a return envelope flap F having a suitable water-activated adhesive layer thereon. The middle and back sheets are perforated along corresponding second lines $\mathbf{11R_2}$ and $\mathbf{12R_2}$ which lie adjacent the left edge of the middle sheet to define a second or minor stub $S_2$.

When, therefore, a pack of the type shown in FIG. 1 is sent to the address of the customer which appears on the face of top sheet 10 and is received by the customer, the first step taken by the customer is to tear off major stub $S_1$. Instructions to this effect may be printed across stub $S_1$. When this is done, the customer may remove insert card 13, as shown in FIG. 4, and then peel off top sheet 10 so that he can examine the bill (FIG. 5) appearing on the rear thereof, which bill he retains as a record.

With top sheet 10 removed, the forwarding envelope is extinguished and now the customer has before him the return envelope formed by sheets 11 and 12, with flap F open. The customer, to pay his bill, inserts a check 14 in the proper amount in the return envelope and folds over and seals flap F onto the second or minor stub $S_2$, as shown in FIG. 7. The sealed return envelope is mailed to the company whose address appears on the face of middle sheet 11. Upon receipt thereof, stub $S_2$ having folded flap F attached thereto is stripped off the envelope, as shown in FIG. 8, and the payment check 14 withdrawn.

Then, as shown in FIG. 9, middle sheet 11 is separated from back sheet 12. Printed on the rear of middle sheet 11, as shown in FIG. 10, is data regarding the account number of the customer and the amount due. Similar data is printed on the face of back sheet 12, as shown in FIG. 11. The amount received as payment may be entered on these record sheets as well as other information relevant to the transaction, one record being held in the branch office responsible for the transaction and the other in the central office of the company. Except for the narrow stubs, no component of the pack is wasted or discarded, in that the sheets which form the envelopes also provide the bill and records of payment.

Since the three sheets which form the pack are unfolded, they may be printed at high speed on webs and combined in a continuous form operation, rather than assembled in separate sheets which must thereafter be collated. The billing and record data appropriate to the customer is preferably entered on the sheets by a Mead "Dijit" image system or an equivalent system involving direct imaging by jet image ink transfer effected by means of an array of hundreds of individually-controlled ink jets each capable of generating thousands of uniform, evenly-spaced ink droplets per second. At the direction of a computer, the droplets are given an electrical charge or left neutral. All droplets then pass through a high-voltage deflection field that allows the neutral droplets to pass through to the paper advancing below to form a portion of a letter, number or other graphic image, the charged droplets being deflected and returned to the ink reservoir.

A computer for controlling the image systems may include a multi-channel IBM compatible magnetic tape on which is recorded the desired billing and addressing information to be imprinted on the moving webs which are combined and severed and ultimately form sheets 10, 11 and 12.

While there has been shown and described a preferred embodiment of a two-way mailer, it will be appreciated that many changes and modifications may be made therein without, however, departing from the essential spirit thereof.

I claim:

1. A two-way mailer for an exchange between a recipient and a forwarder, comprising three superposed sheets having the same dimensions save for the middle sheet whose left edge falls short of the matching left edges of the top and back sheets, said sheets being marginally secured together except at the left edge of the middle sheet to define a pack having a forwarding envelope pocket between the top and middle sheet and a return envelope pocket between the middle and back sheet, the face of the top sheet being addressed to the recipient of the mailer, the face of the middle sheet being addressed to the forwarder of the mailer, the top and back sheets being perforated along corresponding first lines which lie intermediate the left edges of these sheets and the left edge of the middle sheet to define a first stub, the zone of the back sheet between the first line thereon and the edge of the middle sheet constituting a return envelope flap and having an adhesive layer thereon, the middle and back sheet being perforated along corresponding second lines which lie adjacent the left edge of the middle sheet to define a second stub, whereby when the first stub is removed by the recipient the top sheet may be peeled from the pack to extinguish said forwarding envelope and expose the return envelope to permit the flap of the return envelope to be folded over and sealed to said second stub for transmission by the recipient to the forwarder, and when said second stub with the flap thereon is thereafter removed by the forwarder, the contents of said return envelope may be extracted by the forwarder and the middle sheet separated from said back sheet.

2. A mailer as set forth in claim 1, wherein said mailer serves for billing the customers of a company, the face of the top sheet being addressed to a customer who is the recipient and the face of the middle sheet being addressed to the company which is the forwarder, the bill being inserted in said forwarding envelope pocket and being removable therefrom after the first stub is removed and the top sheet peeled off to expose the pocket of the return envelope, and payment being inserted in the exposed return envelope pocket.

3. A mailer as set forth in claim 1, wherein said mailer serves for billing the customers of a company, the face of the top sheet being addressed to a customer and the face of the middle sheet being addressed to the company, the bill being printed on the rear of said top sheet.

4. A mailer as set forth in claim 3, further including an advertising or other insert in said forwarding envelope pocket.

5. A mailer as set forth in claim 3, wherein the face of said back sheet has data thereon relating to payment of the bill.

6. A mailer as set forth in claim 3, wherein the rear of said middle sheet has data thereon relating to payment of the bill.

7. A mailer as set forth in claim 1, wherein said sheets are marginally secured together by spots of adhesive.

* * * * *